US006808258B2

(12) United States Patent
Kaga et al.

(10) Patent No.: US 6,808,258 B2
(45) Date of Patent: Oct. 26, 2004

(54) INK-JET IMAGE FORMING METHOD

(75) Inventors: Makoto Kaga, Tokyo (JP); Shuji Kida, Iruma (JP); Shinichi Suzuki, Saitama (JP); Hidenobu Ohya, Hachioji (JP); Teruyuki Fukuda, Hachioji (JP)

(73) Assignee: Konica Corporation, Tokyo (JP)

( * ) Notice: Subject to any disclaimer, the term of this patent is extended or adjusted under 35 U.S.C. 154(b) by 0 days.

(21) Appl. No.: 10/350,369

(22) Filed: Jan. 23, 2003

(65) Prior Publication Data

US 2003/0189628 A1 Oct. 9, 2003

(30) Foreign Application Priority Data

Jan. 31, 2002 (JP) ..... P2002-023293

(51) Int. Cl.[7] ..... B41J 2/01

(52) U.S. Cl. ..... 347/102; 347/105; 428/342

(58) Field of Search ..... 347/101, 102, 347/105, 106; 428/342

(56) References Cited

U.S. PATENT DOCUMENTS

| | | | | | |
|---|---|---|---|---|---|
| 6,217,166 | B1 | * | 4/2001 | Saito et al. | 347/100 |
| 6,431,701 | B1 | * | 8/2002 | Gallo et al. | 347/101 |
| 6,497,480 | B1 | * | 12/2002 | Wexler | 347/102 |
| 2002/0033869 | A1 | * | 3/2002 | Kurabayashi et al. | 347/100 |
| 2003/0016280 | A1 | * | 1/2003 | Li et al. | 347/106 |
| 2003/0081103 | A1 | * | 5/2003 | Ishimaru et al. | 347/105 |

FOREIGN PATENT DOCUMENTS

| | | | | |
|---|---|---|---|---|
| JP | 06081350 | * | 10/1995 | C09J/131/04 |

* cited by examiner

*Primary Examiner*—Stephen D. Meier
*Assistant Examiner*—Alfred Dudding

(57) ABSTRACT

An ink-jet image recording method is disclosed. In the method and image is formed by jetting ink on an ink-jet recording medium having an ink absorption layer and optionally a layer provided the ink absorption layer on resin coated paper, in which the outermost layer comprises an aqueous emulsion of thermoplastic resin particles synthesized in the presence of polyvinyl alcohol as a protective colloid for emulsion polymerization, and the recording medium is treated by heat.

16 Claims, 1 Drawing Sheet

INK-JET IMAGE FORMING METHOD

FIELD OF THE INVENTION

The invention relates to an ink-jet image recording method, particularly relates to an ink-jet image recording method in which no crack is occurred on the surface of the image, the surface has a high glossiness and the ink is rapidly absorbed.

BACKGROUND OF THE INVENTION

Recently, the technology of ink-jet is considerably progressed and the printed image is attained to the level of usual photographs by the combination of the technology of printer, ink and the exclusive recording medium. Accompany with the improvement of the image quality, the durability of the ink-jet image becomes to be compare with that of the silver halide photograph. Therefore, the following problems have been pointed out; the weakness of water resistively and anti-spreading ability caused by transfer of the colorant and the degradation of the colorant caused by the low resistivity against to light and to the oxidant gas.

Many methods have been proposed for improving the durability of the dye ink image. Regarding the improvement of the ink-jet recording medium, hereinafter simply referred to as the recording medium, Japanese Patent Examined Publication No. 2-31673 discloses a method in which an image is recorded on a medium having a layer composed of a particle of thermoplastic organic polymer provided on the outermost surface of the recording medium, and then the thermoplastic polymer particle is fused to form a continuous layer functioning as a protective layer. Thus improvements on the water fastness and the weather resistance, and the glossiness providing to the image can be attained.

However, the usual recording medium having the layer composed of the thermoplastic organic polymer particle on the outermost surface thereof causes the following problems. First, the glossiness of such the recording medium is insufficient compared with that of the silver salt photograph even though the glossiness is given by the fixing treatment. Such the problem is made remarkable when a pigment ink is used. An image defect or degradation of image quality is particularly occurred when the thermal fixing is applied just after the printing for the purpose of rapid image formation. Secondly, image quality degradation is occurred caused by formation of the bleeding or beading of the color since the ink absorbing speed was reduced by the presence of the layer composed of the thermoplastic resin particles. Particularly, the degradation of the image quality has been become a large problem since the speed of the printer has be made higher for corresponding to the requirement of high-speed printing. Thirdly, the thermoplastic resin added for forming the glossiness causes formation of cracks at the surface of the recording medium. When the glass transition temperature of the thermoplastic resin is low, the resin is fused at the temperature of in the course of the coating and drying process so that the resin functions as the binder. However, when the heating treatment is applied after the printing, a resin having a high transition point is to be selected so that the resin is not fused by the temperature at the production process or that at the storage after the production of the recording medium. In such the recording medium, the amount of the binder is substantially reduced. It is supposed that the strength of the coated layer is lowered so as to be occurred the cracks. The formation of the cracks can be inhibited by reducing the amount of the thermoplastic resin but the lowering of the glossiness is occurred.

Japanese Patent Publication Open to Public Inspection, hereinafter referred to as JP O.P.I. No. 7-117334 discloses technology relating to the ink-jet recording sheet comprising polyvinyl alcohol or PVA having a degree of polymerization of 4,000 or more and inorganic fine particles having an average particle diameter of less than 0.1 $\mu$m. The glossiness is surely improved by such the technique. However, considerable viscosity raising of the coating liquid for producing the ink-jet recording sheet is occurred by such the measure so that troubles on the coating tend to be occurred.

JP O.P.I. No. 8-318671 discloses technology in which a layer comprising hydrophobic particles having an average particle diameter of not more than 0.3 $\mu$m dispersed in a medium of a water absorbable binder is piles. The object of the technology is the improvement of optical transparency of the transparent recording medium using a transparent substrate.

JP O.P.I. No. 2000-211243 discloses technology relating to an ink-jet coating material comprising a binder and an aqueous dispersion containing a particle having a specified specific surface area and particle diameter. The object of this technology is to improve the water resistance and transparency of the image formed by a dye ink.

The invention relates to an ink-jet image recording method improved in the occurrence of the cracks on the image surface during the storage extend over a long duration.

As a result of the investigation by the inventors, the following problems are found.

First, the glossiness is insufficient compared with that of the silver salt photograph.

Secondly, an old or commercially used high speed printer has a low ink absorbing speed, and the image quality is considerably degraded by occurrence of beading and color bleeding.

Thirdly, it is difficult to stably produce a satisfactory product with a lower cost since crack default occurs in the coating and drying process.

Fourthly, the cracks are often occurred on the surface of the image when the image is stored for a long period.

SUMMARY OF THE INVENTION

The invention is carried out on the above-mentioned background. The object of the invention is to provide an ink-jet image recording method by which the crack occurrence on the image surface is inhibited and an excellent ink absorbing speed is obtained.

The invention and the embodiment thereof are described below.

An ink-jet image recording method comprising the steps of forming an image on an ink-jet recording medium having at least one ink absorption layer on resin coated paper (RC paper), in which the outermost layer comprises an aqueous emulsion of thermoplastic resin particles which is synthesized in the presence of polyvinyl alcohol as a protective colloid for emulsion polymerization, and then treating the recording medium by heat.

The degree of saponification of the polyvinyl alcohol is preferably not more than 90%.

The glass transition temperature of the thermoplastic resin particles is preferably from 40 to 100° C.

The average particle diameter of the thermoplastic resin particles is preferably not more than 300 nm.

The amount of the solid composition of the thermoplastic resin particles is preferably from 1 to 10 g/m$^2$.

In one of the embodiments, the degree of polymerization of the polyvinyl alcohol is preferably from 300 to 1,500.

The image is preferably formed by a pigment ink.

The outermost layer preferably further contains inorganic fine particles.

An ink-jet image recording method comprising the steps of forming an image on an ink-jet recording medium having an ink absorption layer on RC paper, in which the outermost layer comprises an aqueous emulsion of thermoplastic resin particles which is synthesized in the presence of polyvinyl alcohol having a degree of polymerization of from 1,500 to 4,500 as a protective colloid for emulsion polymerization, drying the ink-jet recording medium having the image formed, and then treating the recording medium by heat.

An ink-jet image recording method comprising the steps of forming an image on an ink-jet recording medium having an ink absorption layer on RC paper, in which the outermost layer comprises an aqueous emulsion of thermoplastic resin particles which is synthesized in the presence of polyvinyl alcohol having a degree of polymerization of from 1,500 to 4,500 as a protective colloid for emulsion polymerization, and then treating the recording medium by heat and pressure with a pressure of from 5 to 20 MPa.

DETAILED DESCRIPTION OF THE INVENTION

Figure 1:
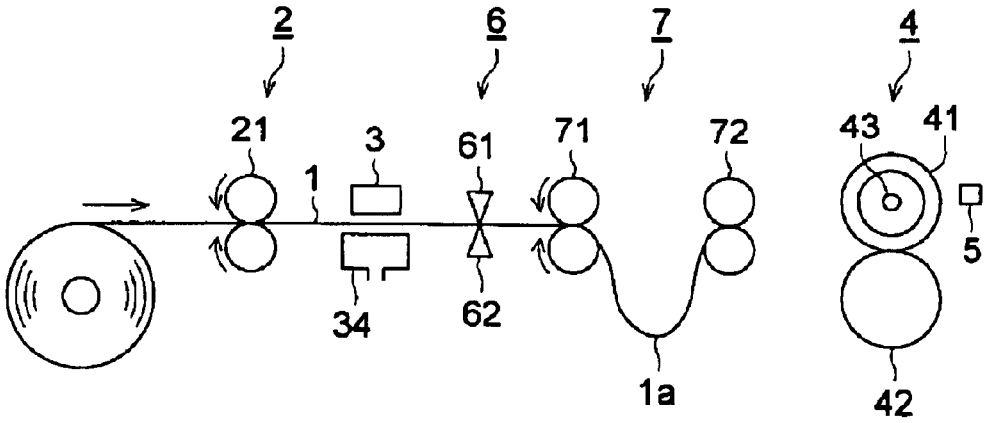
FIG. 1 shows a schematic constitution of an example of the ink-jet recording apparatus to be used in the invention having a heating roller.

The image recording method according to the invention comprises the steps of forming an image by an ink on the recording medium containing the aqueous emulsion of thermoplastic resin particles synthesized in the presence of polyvinyl alcohol in the outermost layer thereof, and then heat treating the recording medium after the image forming. The ink-jet recording medium employed in the invention has at least one ink absorption layer on a support, and the outermost layer among the ink absorption layers comprises the aqueous emulsion of thermoplastic resin particles which are synthesized in the presence of polyvinyl alcohol.

The inventors investigate the image recording method in which the image is recorded on the recording medium having the outermost layer containing the thermoplastic resin particles, and the recording medium on which the image is printed is subjected to the treatment by heat. As a result of the investigation of various kinds of thermoplastic resin particles, it has been found that the crack occurrence in the production process is inhibited and a high glossiness can be obtained when an aqueous emulsion of thermoplastic resin particles synthesized in the presence of polyvinyl alcohol, particularly polyvinyl alcohol having a degree of polymerization of from 300 to 1,500, as the protective colloid for emulsion polymerization is employed. It has been further found that high glossiness can be obtained when the image is formed by a pigment ink, even though the high glossiness can be difficultly obtained by the pigment ink in usual.

It has been further found that such the effects are enhanced when the degree of saponification of the polyvinyl alcohol is not more than 90%, or the resin particle has the glass transition temperature Tg of the resin particles obtained by employing the polyvinyl alcohol is from 40 to 100° C. and the average particle diameter is not more than 300 nm.

It has been found that that the satisfactorily high glossiness can be obtained even when the coating amount of the thermoplastic resin particles is from 1 to 10 g/m$^2$, and such the recording medium is excellent in the ink absorption ability.

It has been further found that the ink absorption speed can be considerably raised by addition of an inorganic fine particle into the outermost layer.

Moreover, the condition of the heat treatment and the pre-condition thereof has been investigated. As a result of that, it has been found that the high glossiness can be obtained even when a resin particle synthesized in the presence of the polyvinyl alcohol having a degree of polymerization of from 1,500 to 4,500 as the protective colloid for emulsion polymerization among the aqueous emulsion of thermoplastic resin particles is used in the outermost layer. Moreover, it has also found that the use of such the thermoplastic resin particles shows very high inhibiting effect on the crack occurrence in the production process and that on the inhibition effect on the crack formation on the printed image during the storage for a long period.

The recording medium according to the invention is described below.

The recording medium according to the invention has at least one ink absorption layer, preferably one, two or three ink absorption layers, and more preferably one or two layers.

The outermost layer containing the thermoplastic resin particles is described.

The outermost layer comprises the emulsion of the thermoplastic resin particles synthesized by the use of polyvinyl alcohol as the protective colloid for emulsion polymerization.

As the thermoplastic fine particle in the outermost layer, the particle of a polyacrylate, a polycarbonate, polyacrylonitrile, polystyrene, polybutadiene, polyacrylic acid, polymethacrylic acid, polyvinyl chloride, polyvinylidene chloride, polyvinyl acetate, polyester, polyether, and a copolymer thereof and a salt thereof are usable. Among them the particle of an acrylate copolymer, a styrene-acrylate copolymer, a vinyl chloride-vinyl acetate copolymer, a vinyl chloride-acrylate copolymer, an ethylene-vinyl acetate copolymer and SBR latex are preferable. Polyacrylate copolymer is most preferable. A mixture of plural kinds of polymer particle different from each other in the monomer composition, the particle diameter or the degree of polymerization may be used.

As a norm for selecting the thermoplastic resin particles to be contained in the outermost layer, the glass transition temperature Tg of the resin is applicable. For example, when the Tg is extremely low, voids between the thermoplastic fine particles are disappeared since the temperature for coating and drying in the production process of the recording medium is higher than the Tg. When the Tg is extremely high, the fixing treatment at high temperature is required for fixing by film formation by fusing after the ink-jet image forming by the ink. Accordingly, the Tg of the thermoplastic resin particles contained in the outermost layer is preferably from 40 to 100° C., and that having the minimum film forming temperature of from 40 to 100° C. is preferable.

The average particle diameter of the thermoplastic particles is preferably not more than 300 nm and there is no specific lower limitation and that not less than about 80 nm is preferable form the viewpoint of the production method and handling.

The thermoplastic resin particles according to the invention is preferably one dispersed in an aqueous system from the viewpoint of the environmental suitability, and an aqueous emulsion obtained by emulsion polymerization is particularly preferred. In the polymerization process, polyvinyl alcohol is used as the emulsion polymerization agent. A nonionic or cationic surfactant may be used for controlling the emulsifying ability. In one of the embodiments, the degree of polymerization of the polyvinyl alcohol of from 300 to 1,500 is preferable. The degree of polymerization of from 500 to 1,300 is more preferable.

In another embodiment, a polyvinyl alcohol having a degree of polymerization of from 1,500 to 4,500 is used as the protective colloid for emulsion polymerization. The higher degree of polymerization is preferable from the viewpoint of the inhibition of the crack defect and the cracking of the image duration of storage for a long period; the degree of polymerization of from 2,500 to 4,500 is particularly preferable from such the viewpoint. The degree of polymerization of from 1,500 to 2,500 is preferable from the viewpoint of the ink absorption speed.

The degree of saponification of the polyvinyl alcohol is not more than 90 mole %, the lower value is preferably not less than 20 mole % even though the lower limit is not specified. The monomer component remained in the thermoplastic resin particles is preferably as small as possible from the viewpoint of the bad odor and safety. The content of the remaining monomer is preferably not more than 3% by weight, more preferably not more than 1% by weight, particularly preferably not more than 0.1% by weight.

The thermoplastic resin particles are obtained by the emulsion polymerization in the presence of the polyvinyl alcohol. It is preferable that the polyvinyl alcohol is dissolved using a solvent, if it is necessary, in the monomer before the polymerization reaction.

The polyvinyl alcohol at least functions as the protective colloid in the polymerization reaction. In the polymerization reaction, the polyvinyl alcohol inhibits the unnecessary raising of the viscosity and stabilizes the formed resin particles. Furthermore, a part of the polyvinyl alcohol is included in the interior and the surface of the thermoplastic resin particles as a result of the polymerization reaction, even though that is not confirmed. The thermoplastic resin particles synthesized by emulsion polymerization in the presence of the polyvinyl alcohol are different from the fine particle synthesized without presence of the polyvinyl alcohol in chemical and physical properties thereof. Therefore, it is supposed that the recording medium containing such the fine particle in the outermost layer uniquely behaves when the recording medium is subjected to the treatment by heating or heating and pressing.

The amount of PVA used for the polymerization as a protective colloid is from 1% to 20%, preferably from 3% to 15%, by weight of the monomer.

The protective colloid is preferably allowed to co-exist and be agitated with monomer before initiation of polymerization.

In the invention the emulsion is preferably synthesized by radical polymerization. At the polymerization, usually used a peroxide compound such as a persulfate or an azo compound may be used, and a chain-transfer agent may also be used.

A lot of the hydrophilic portion of PVA exists at the surface of the thermoplastic particle polymerized in the presence of PVA and contributes to the stability of the dispersion. The mechanism of the effects of the use of the thermoplastic particle is considered as follows.

The occurrence of the cracks is lower in the layer using the emulsion of the thermoplastic resin polymerized in the presence of PVA than the crack occurrence in a layer containing an emulsion using a usual surfactant since the hydrophilic portions at the surface of the emulsion particle using the PVA are three dimensionally bonded by hydrogen bonds to form a relatively strong layer. In more preferable embodiment in which the recording medium contains a water-soluble binder and an inorganic fine particle such as silica, a stronger layer is formed by the bonding between the thermoplastic particle and the binder or the inorganic particle, thus a high crack resistance can be obtained. In such the case, it is particularly preferable to raise the degree of polymerization of the PVA. As above-mentioned, the strong, uniform and smooth layer can be formed at the surface of the ink-jet recording medium. Such the effect is caused by that the emulsion-polymerized emulsion comprises fine particles and the coating liquid has a high uniformity. It is supposed that such the results are attained by the use of the PVA. The layer has suitable miscibility with a usual aqueous ink containing water and a polyvalent alcohol, and such the layer is preferable from the viewpoint of the ink absorbability. As a result of that, the high glossiness can be obtained. In the embodiment of the invention, the heat treatment is applied. The layer containing the emulsion shows a high free deformation degree at the time of the surface smoothing by the heat treatment. Moreover, the layer has a high affinity with the pigment particle in a pigment ink, and the pigment particle is effectively taken in the surface and the interior of the layer so that a usually not obtainable high glossiness can be obtained.

The outermost layer containing the thermoplastic resin particles preferably contains a water-soluble binder. Examples of the binder include polyvinyl alcohol, gelatin, polyethylene oxide, polyvinyl pyrrolidone, polyacrylic acid, polyacrylamide, polyurethane, dextran, dextrin, carrageenan such as κ-, ι- and λ-carrageenan, agar, Pullulan, water-soluble polyvinyl butyral, hydroxyethyl cellulose and carboxymethyl cellulose. Two or more kinds of the above water-soluble resin may be used in combination. The using amount of the binder is preferably from 1 to 10% of the thermoplastic resin particles.

The water soluble resin used as a binder in the invention is preferably polyvinyl alcohol. The usable polyvinyl alcohol include a modified polyvinyl alcohol such as a polyvinyl alcohol cationically modified at the terminal and an anionically modified polyvinyl alcohol having an anionic group, additionally a usual polyvinyl alcohol obtained by saponification of polyvinyl acetate.

The polyvinyl alcohol obtained by saponification of polyvinyl acetate having an average degree of polymerization of not less than 1,000 is preferably used. One having an average degree of polymerization of from 1,500 to 5,000 is particularly preferable. A degree of saponification of from 70 to 100% is preferable and that of from 80 to 99.5% is particularly preferable.

A hardening agent for the binder is preferably contained in the outermost layer. The purpose of addition of the hardening agent is to make a crosslink between the binder molecules in the ink absorption layer or the binder and the thermoplastic resin particles in the ink absorption layer.

The hardening agent is optionally selected according to the kind of the binder or the thermoplastic resin particles. In concrete, the hardening agent selected from the followings is preferably used: an epoxy type hardening agent such as diglycidyl ethyl ether, ethylene glycol diglycidyl ether, 1,4-butanediol ether, 1,6-diglycidyl-cyclohexane, N,N-diglycidyl-4-glycidyloxyaniline, sorbitol polyglycidyl ether and glycerol polyglycidyl ether; an aldehyde type hardener such as formaldehyde and glyoxal; an active halogen type hardener such as 2,4-dichloro-4-hydroxy-1,3,5-s-triazine; an active vinyl type hardener such as 1,3,5-tris-acroyl-hexahydro-s-triazine; a boric acid and its salt, borax and aluminum alum. The hardening agent selected from the boric acid and the salt thereof and the epoxy type hardening agent is preferable when the polyvinyl alcohol and/or the cationically modified polyvinyl alcohol are used as the preferable binder. The most preferable hardener is one selected from the boric acid and the salt thereof. The boric acid and the salt thereof means an oxygen acid having a boron atom as the center atom thereof and the salts of them, and concrete examples thereof include orthoboric acid, diboric acid, metaboric acid, tetraboric acid, pentaboric acid octaboric acid and the salt of them. The using amount of the hardening agent is usually from 5 to 500 mg, preferably from 10 to 300 mg, per gram of the binder, even though the amount may be changed according to the kind of the water-soluble resin, the kind of the hardening agent, the kind of the inorganic fine particle or the ratio of the inorganic fine particle to the binder. The foregoing hardening agent may be added to the coating liquid for the outermost layer at the time of the coating. In another way, the coating liquid for forming the outermost layer may be coated on the support on which a coating liquid containing the hardening agent is previously coated.

A cationic water-soluble polymer is preferably contained in the outermost layer from the viewpoint of improvement of the image quality. Particularly, a cationic water-soluble polymer having a quaternary ammonium salt may be contained in the outermost layer, which is usually used within the range of from 0.1 to 10 g, preferably from 0.2 to 5 g, per square meter of the ink-jet recording medium.

It is particularly preferable that the inorganic fine particles are mixed in the outermost layer which contains the thermoplastic resin contains for improving the ink absorption speed.

Examples of the inorganic fine particle to be mixed include a white pigment such as light calcium carbonate, heavy calcium carbonate, magnesium carbonate, kaolin, clay, talc, calcium sulfate, barium sulfate, titanium dioxide, zinc oxide, zinc hydroxide, zinc sulfide, zinc carbonate, hydrotalcite, aluminum silicate, diatomite, calcium silicate, magnesium silicate, synthesized amorphous silica, colloidal silica, alumina, colloidal alumina, pseudboehmite, aluminum hydroxide, lithopone, zeolite and magnesium hydroxide.

As the inorganic fine particles, solid fine particles selected from the silica and hydrated alumina are preferable and the silica is more preferable.

As the silica, silica synthesized by usual wet method, colloidal silica and silica synthesized by gas phase method are preferably used. The silica fine particle preferably used in the invention is the colloidal silica and the fine silica particles synthesized by gas phase method. Among them, a high porosity can be obtained by the fine silica particles synthesized by gas phase method. The alumina and the hydrated alumina may be crystalline or amorphous, and one having an optional shape such as an irregular-shaped particle, a sphere-shaped particle and needle-like shaped particle.

The particle diameter of the inorganic particle is preferably not more than 100 nm. For example, in the case of the fine silica particles synthesized by gas phase method, the average diameter of the primary particle of the inorganic fine particle dispersed in the state of primary particle, namely the particle diameter in the dispersion before the coating, is preferably not more than 100 nm, more preferably from 5 to 50 nm, most preferably from 4 to 20 nm.

The most preferable usable silica synthesized by gas phase method having a primary particle diameter of from 4 to 20 nm is available in the market as, for example, Aerosil produced by Nihon Aerosil Co. Ltd. The silica fine particle synthesized by gas phase method can be dispersed relatively with ease until the status of primary particle by suction-dispersing a mixer such as Jet-stream Inductor Mixer manufactured by Mitamura Riken Kogyo Co., Ltd.

In such the case, the weight ratio of the thermoplastic resin and the inorganic fine particle in the outermost layer can be optionally selected. The ratio is preferably from 2/8 to 8/2, more preferably from 3/7 to 7/3, further preferably from 4/6 to 6/4.

It is particularly preferable from the viewpoint of the ink absorption ability that the ratio of the inorganic fine particle to the whole solid components in the outermost layer is from 30% to 70%.

In the recording medium according to the invention, another ink absorption layer is preferably provided between the outermost layer and the support.

The ink absorption layer can be roughly classified into a swelling type and a porous type; and both of them are usable.

In the swelling type, a hydrophilic binder such as gelatin, polyvinyl alcohol, polyvinyl pyrrolidone and polyethylene oxide may be coated solely or in combination for using as the ink absorption layer.

The porous type ink absorption layer is a porous layer having voids absorbing the ink, which is obtained by coating a mixture of a fine particle and a hydrophilic binder. As the fine particle, alumina and silica are preferable; silica having a particle diameter of not more than 0.1 $\mu$m is particularly referable. Solely or combination use of gelatin, polyvinyl alcohol, polyvinyl pyrrolidone and polyethylene oxide is preferably as the hydrophilic binder. As the porous type ink absorption layer, one having a high glossiness is particularly preferable.

It is preferable that the ink is absorbed by the recording medium as rapidly as possible for providing the suitability to the continuous or high-speed printing. Therefore, the voids type is particularly preferable.

The voids type ink absorption layer or the layer having voids is described in detail below.

The layer having voids is mainly constituted by soft coagulation of the hydrophilic binder and the inorganic fine particles. Various methods for forming the voids in the layer are known. For example, the following methods are known: a method in which a uniform coating liquid containing two or more kinds of polymer is coated on the support and of the polymers are separated from each other by phase separation to form the voids in the course of the drying; a method in which a coating liquid containing solid particles and a hydrophilic or hydrophobic binder is coated and dried on the support and then the dried recording medium is immersed into water or a liquid containing a suitable organic solvent for dissolving out the solid fine particle to form the voids; a method in which a coating liquid containing an agent capable of foaming at the time of layer formation and making foams in the layer in the course of drying to form the voids: a method in which a coating liquid containing porous solid fine particles and a hydrophilic binder is coated on the support to form voids in or between the porous particles, and a method in which a coating liquid containing a hydrophilic binder and solid particles and/or fine oil droplets having a volume about equal or more of the volume of the hydrophilic binder is coated on the support to form voids between the solid fine particles.

In the invention, it is particularly preferable that the layer having voids contains inorganic fine particles having an average diameter of not more than 100 nm.

The inorganic fine particle usable in the outermost layer is also may be used as the inorganic fine particle to be used for the foregoing purpose.

As the hydrophilic binder, the binder the same compound as those described as the water-soluble binder in the outermost layer.

The adding amount of the inorganic fine particle to the ink absorption layer is usually from 5 to 30 g, preferably from 10 to 25 g, per square meter of the ink-jet recording medium even though the amount dependents largely on the required ink absorption capacity, the porosity of the layer having voids, kind of the inorganic fine particle and the kind of the water-soluble resin.

The ratio of the inorganic fine particle to the water-soluble resin in the ink absorption layer is usually from 2:1 to 20:1, preferably from 3:1 to 10:1, by weight.

The ink absorption layer may contain a water-soluble cationic polymer having a quaternary ammonium base in the molecule thereof; the water-soluble cationic polymer is usually used in an amount of from 0.1 to 10 g, preferably from 0.2 to 5 g, per square meter of the ink-jet recording medium.

In the layer having voids, the total volume of the voids or the void volume is preferably not less than 20 ml per square meter of the recording medium. If the void volume is less than 20 ml/m$^2$, problems such as that the ink absorption is made insufficient when the large amount of the ink is supplied on occasion of the printing and degradation in the image quality and the drying ability tend to be occurred even though the ink absorption is suitably performed when the ink amount is small.

For another porous type, other than the method for making the ink absorption layer by using the inorganic fine particles, the ink absorption layer may be formed by using a coating liquid containing a urethane resin emulsion, a water-soluble epoxy compound and/or acetoacetylated polyvinyl alcohol and epichlorohydrin amide resin. In such the case, the polyurethane emulsion is preferably an emulsion of polyurethane having a polycarbonate chain, or a polycarbonate chain and a polyester chain and a particle diameter of 3.0 $\mu$m. It is further preferable that the polyurethane of the polyurethane emulsion is one produced by reaction of a polyol having a polycarbonate polyol or a polycarbonate polyol and a polyester polyol with an aliphatic isocyanate compound and the polyurethane has a sulfonic acid group in the molecular thereof and further has epichlorohydrin polyamide resin and a water-soluble epoxy compound and/or acetoacetylated polyvinyl alcohol.

It is supposed that a weak coagulation of the cation and the anion is occurred in the foregoing ink absorption layer so that the void having the ink solvent absorbing ability is formed.

The thickness of the ink absorption layer is from 20 to 50 $\mu$m when the outermost layer is only used. When the recording medium has the ink absorption layer other than the outermost layer, the ink absorption layer is from 20 to 50 $\mu$m, preferably from 20 to 40 $\mu$m. In such the case, the outermost layer is from 2 to 15 $\mu$m, preferably from 5 to 10 $\mu$m.

The recording medium has preferably one, two or three ink absorption layers. The outermost layer contains an emulsion of thermoplastic resin particles which are synthesized in the presence of polyvinyl alcohol as a protective colloid for emulsion polymerization. When the recording medium has one ink absorption layer, the ink absorption layer is the outermost layer. When the recording medium has two ink absorption layers, it has the ink absorption layer between the outermost layer and the support. When the recording medium has three ink absorption layers, it has, for example, a first ink absorption layer containing alumina particles, a second ink absorption layer containing silica particles and the outermost layer on the support in this order, or a first ink absorption layer containing coarse silica particles, a second ink absorption layer containing fine silica particles and the outermost layer on the support in this order.

The ink absorption layer may contain a hardening agent and a cationic water-soluble polymer. As the hardener and the cationic water-soluble polymer, the compounds the same as described with respect to the outermost layer.

The RC support is a paper support prepared by laminating the both sides of a raw paper by a plastic resin film. The RC support laminated by polyethylene is described below.

The raw paper to be used for the paper support is made using wood pulp as the main raw material and additionally using a synthesized pulp such as polypropylene or synthesized fiber such as nylon and polyester according to necessity. As the wood pulp, it is preferable that LBPK, NBSP, LBSP, NDP or LDP each having a large short fiber content are used in a higher ratio Even though any of LBPK, LBSP, NBKP, NBSP, NDP, LUPK and NUKP are usable. The ratio of LBSP and/or LDP is preferably from 10 to 70% by weight.

Chemical pulp each having small impurity content such as sulfate pulp and sulfite pulp is preferably used and pulp subjected to a bleaching treatment for raising the whiteness is also usable. A sizing agent such as a higher fatty acid and an alkylketene dimer; a white pigment such as calcium carbonate, talc and titanium dioxide; a paper strength raising agent such as starch, polyacrylamide and polyvinyl pyrrolidone; a fluorescent whitening agent; and a softening agent such as a quaternary ammonium compound may be optionally added to the raw paper.

The water freeness according to the rule of CSF of the pulp to be used is preferably from 200 to 500 ml. The length of the fiber after beating represented by the sum of the weight-% of 24 mesh residues and the weight-% of 42 mesh residues according to the definition of JIS-P-8207 is preferably from 30 to 70% by weight. The ratio of the 42 mesh residues is preferably not more than 20% by weight. The weight of the raw paper is preferably from 30 to 250 g/m$^2$, particularly preferably from 50 to 200 g/m$^2$. The thickness of the raw paper is preferably from 40 to 250 $\mu$m. The raw paper may be subjected to a calender treatment in the course of or after the paper making to provide high smoothness. The density of the raw paper according to JIS-P-8118 is usually from 0.7 to 1.2. The stiffness of the raw paper is preferably from 20 to 200 g under the condition according to JIS-P-8143. The surface of the raw paper may be coated with a surface sizing agent. As the surface sizing agent, the foregoing sizing agent to be added into the paper can be used. The pH of the raw paper is preferably from 5 to 9 when the value is measured by the hot water extract method defined in JIS-P-8113.

Polyethylene covering the surface and back surface of the raw paper is made mainly low density polyethylene, LDPE, and/or high density polyethylene, HDPE, and another polymer such as straight-chain low density polyethylene, LLDPE, and polypropylene partially may be used. Polyethylene laminated paper may be used in a form of glossy paper, and one on which a matted surface or silk surface such as usual photographic paper is formed by embossing treatment on the occasion of that the polyethylene is coated on the surface of the raw paper by melting and extrusion. The using amount of the polyethylene on the surface and the back surface of the raw paper is decided so as to optimize the curling of the recording medium after providing the ink absorption layer and the backing layer under a low or high humidity condition. The thickness of the polyethylene layer on the side of the ink absorption layer is usually from 20 to 40 $\mu$m and that of the back side is from 10 to 30 $\mu$m.

The foregoing paper support laminated with the polyethylene preferably has the following properties.

1. Tensile strength: Preferably from 2 to 30 kg in the grain direction and from 1 to 20 kg in the cross direction according to the strength defined in JIS-P-8113

2. Tear strength: Preferably from 10 to 200 g in the grain direction and from 20 to 200 g in the cross direction according to the strength defined in JIS-P-8116

3. Compression elastic modulus$\geqq$98.1 MPa

4. Opacity: Preferably not less than 80%, particularly preferably from 85 to 98% according to the measuring method defined in JIS-P-8138

5. Whiteness: Preferably L*=80 to 95, a*=−3 to +5, b*=−6 to +2, in which L*, a* and b* are values defined in JIS-Z-8729.

6. Clark's stiffness: Support having a Clark's stiffness in the grain direction of from 50 to 300 $cm^2/100$ is preferred.

7. Moisture content of the raw paper: moisture content of from 4 to 100% by weight is preferable.

The coating method of various constituting layers provided according to necessity such as the outermost layer of the recording medium, the ink absorption layer and the subbing layer on the support may be optionally selected from known methods. A method is preferable in which the coating liquids each constituting the respective layer is coated on the support and dried to obtain the recording medium.

Examples of the coating method include a roll coating method, a rod bar coating method, an air knife coating method, a spray coating method, a curtain coating method and an extrusion coating method using a slide hopper such as that described in U.S. Pat. No. 2,681,294. A thickener may be used for raising the coating suitability of the coating liquid on the occasion of the coating. The pigment as the coloring component of the pigment ink is captured at the surface so as to forms an image. Then the status of the outermost layer is varied by applying heat and pressure corresponding to necessity for raising the fastness of the image and to make the suitable glossiness.

The ink is described below.

An aqueous ink composition, an oily ink composition and a solid, phase variation, ink composition may be used for forming the image. The aqueous ink composition such as an aqueous ink-jet ink containing 10% by weight or more water to the whole weight of the ink is particularly preferred.

Various kinds of ink such as a dye ink, a pigment ink and a dispersion ink may be used; and the pigment ink is preferably used since such the ink has high image durability.

An organic pigment such as an insoluble pigment and a lake dye and carbon black are preferably used as the pigment.

Examples of the insoluble pigment include an azo pigment, an azomethine pigment, a methine pigment, a diphenylmethane pigment, a triphenylmethane pigment, a quinacridone pigment, an anthraquinone pigment, a perylene pigment, an indigo pigment, a quinophthalone pigment, an isoindolinone pigment, an isoindoline pigment, an azine pigment, an oxazine pigment, a thiazine pigment, a dioxazine pigment, a thiazole pigment, a phthalocyanine pigment, a diketo pigment and a pyrrolopyrrole pigment.

Examples of preferably usable concrete pigment are shown below. Examples of red pigment include C.I. Pigment Red 2, C.I. Pigment Red 3, C.I. Pigment Red 5, C.I. Pigment Red 6, C.I. Pigment Red 7, C.I. Pigment Red 15, C.I. Pigment Red 16, C.I. Pigment Red 48:1, C.I. Pigment Red 53:1, C.I. Pigment Red 57:1, C.I. Pigment Red 122, C.I. Pigment Red 123, C.I. Pigment Red 139, C.I. Pigment Red 144, C.I. Pigment Red 149, C.I. Pigment Red 166, C.I. Pigment Red 177, C.I. Pigment Red 178 and C.I. Pigment Red 22. Among them, C.I. Pigment Red 122 is preferable. Examples of orange or yellow pigment include C.I. Pigment Orange 31, C.I. Pigment Orange 43, C.I. Pigment Yellow 12, C.I. Pigment Yellow 13, C.I. Pigment Yellow 14, C.I. Pigment Yellow 15, C.I. Pigment Yellow 17, C.I. Pigment Yellow 74, C.I. Pigment Yellow 93, C.I. Pigment Yellow 94, C.I. Pigment Yellow 128 and C.I. Pigment Yellow 138. Among them, C.I. Pigment Yellow 74 and C.I. Pigment Yellow 128 are preferable.

Examples of green or cyan pigment include C.I. Pigment Blue 15, C.I. Pigment Blue 15:2, C.I. Pigment Blue 15:3, C.I. Pigment Blue 16, C.I. Pigment Blue 60 and Pigment Green 7. Among them, C.I. Pigment Blue 15:3 is preferable.

A pigment dispersing agent may be used for these pigments, according to necessity. Examples of compound usable as the pigment dispersing agent include a surfactant such as a higher fatty acid salt, an alkyl sulfate, an alkyl ester sulfate, an alkylsulfonate, a sulfosuccinate, a naphthalenesulfonate, an alkylphosphate, a polyoxyalkylene alkyl ether phosphate, a polyoxyalkylene alkylphenyl ether, a polyoxyethylene polyoxypropylene glycol, glycerol ester, a sorbitol ester, a polyoxyethylene fatty acid amide and an amine oxide; and a block copolymer, a random copolymer and a salt of them constituted by two or more monomers selected from styrene, a styrene derivative, a vinylnaphthalene derivative, acrylic acid, an acrylic acid derivative, itaconic acid, an itaconic acid derivative, fumaric acid and a fumaric acid derivative.

For dispersing the pigment, various methods are applicable each using a ball mill, a sand mill, an attriter, a roll mill, an agitator, a Henschel mixer, a colloid mill, a ultrasonic homogenizer, a pearl mill, a wet jet mill and a paint shaker, respectively. The method using a centrifugal machine and that using a filter are preferable for removing coarse particles of the pigment dispersion.

The average particle diameter of the pigment in the pigment dispersion is decided on the consideration of the stability of the dispersion in the ink, the density of image, the glossiness and the light fastness. Moreover, in the invention, the diameter is preferably selected on the viewpoint of improvement of the glossiness and the textile feeling. It is supposed that such the effects relates to the fact that the pigment is dispersed in the layer of the molted thermoplastic fine particles at the image, even though the reason of the improvement in the glossiness and the textile feeling in the invention is not cleared yet. When the purpose of the high speed printing, the thermoplastic resin particles should be changed to the molten layer and the pigment is sufficiently dispersed in the layer in a moment. It is supposed that an optimum region of the particle diameter exists since the surface area of the pigment is largely influences on such the occasion.

The average diameter of the pigment contained in the pigment ink to be used in the invention is preferably not more than 300 nm, further preferably from 30 to 200 nm, particularly preferably from 30 to 150 nm.

In the aqueous ink composition which is a preferable embodiment of the pigment ink, a water-soluble organic solvent is preferably contained.

Examples of the water-soluble organic solvent include an alcohol such as methanol, ethanol, propanol, iso-propanol, butanol, iso-butanol, sec-butanol, tert-butanol, pentanol, hexanol, cyclohexanol and benzyl alcohol; a polyvalent alcohol such as ethylene glycol, diethylene glycol, triethylene glycol, polyethylene glycol, propylene glycol, butylenes glycol, dipropylene glycol, polypropylene glycol, butylenes glycol, hexanediol, pentanediol, glycerol, hexanetriol and thiodiglycol; a polyvalent alcohol ether such as ethylene glycol monomethyl ether, ethylene glycol monoethyl ether, ethylene glycol monobutyl ether, diethylene glycol monomethyl ether, diethylene glycol monomethyl ether, diethylene glycol monobutyl ether, propylene glycol monomethyl ether, propylene glycol monobutyl ether, ethylene glycol monomethyl ether acetate, triethylene glycol monomethyl ether, triethylene glycol monoethyl ether, triethylene glycol monobutyl ether, ethylene glycol monophenyl ether, propylene glycol monophenyl ether; an amine such as ethanolamine, diethanolamine, triethanolamine, N-methyldiethanolamine, N-ethyldiethanolamine, morpholine, N-ethylmorpholine, ethylenediamine, diethylenediamine, triethylenetetramine, tetraethylenepentamine, polyethyleneimine, pentamethyldiethylenetriamine and tetramethylpropylenediamine; an amide such as formamide, N,N-dimethylformamide and N,N-dimethylacetoamide; a heterocyclic compound such as 2-pyrrolidone, N-methyl-2-pyrrolidone, cyclohexylpyrrolidone, 2-oxazolidone, 1,3-dimethyl-2-imidazolidinone; a sulfoxide such as dimethylsulfoxide; a sulfone such as sulfolane; urea, acetonitrile and acetone. The polyvalent alcohol is preferable as the water-soluble organic solvent. The combination use of the polyvalent alcohol and the polyvalent alcohol ether is particularly preferable.

The water-soluble organic solvent may be used solely or in combination. The adding amount of the water-soluble organic solvent into the ink is from 5 to 60%, preferably from 10 to 35%, by weight in total.

The pigment ink to be used in the invention is preferably contains an acetylene type surfactant. Acetylene diol and an adduct of that with ethylene oxide are preferable as the acetylene type surfactant.

Surfinol 82, Surfinol 104, Surfinol 440, Surfinol 465 and Surfinol 485, each produced by Air Products Co., Ltd., are preferably used as the acetylene diol and an adduct of that with ethylene oxide.

An additive such as a thermoplastic fine particle, a viscosity controlling agent, a surface tension controlling agent, an electric resistively controlling agent, a film forming agent, a dispersing agent, a surfactant, a UV absorbent, an antioxidant, a discoloration inhibiting agent, an anti-mould agent and an anti-rusting agent may be added to the ink composition according to the purpose of the improvement such as ink releasing stability, the suitability for print head or ink cartridge, the storage stability and the image durability.

The surface tension of the ink composition on the occasion of flying is preferably not less than 20 mN/m. The surface tension of at least one of the inks is preferably from 25 to 50 mN/m, more preferably from 30 to 45 mN/m, for obtaining high ink absorption speed without degradation of image quality and high glossiness after the heat treatment, and for inhibiting a trouble such as peeling off of the layer in the course of the process previous to the heat treatment or in the heat treatment itself.

The content of the solid pigment component in the ink is preferably from 0.1 to 10%. A high color density ink and a low color density ink, in which the pigment solid contents are different from each other, are preferably used for obtaining a photograph like image. It is particularly preferable to use the high- and low-density inks of yellow, magenta, cyan and black inks, respectively. The use of special color ink such as red, green or blue ink according to necessity is preferable for color reproduction.

It is preferable that at least one of the colors of the image is recorded by two or more inks each different in the colorant content to improving the granularity and to obtain an image having a plentiful gradation and high glossiness. Particularly, it is preferable to use a set of inks different in the colorant content from each other with respect to two ore more, more preferably three or more, colors among yellow, magenta cyan and black. The ratio of the colorant contents in the high-density ink to the low-density ink is preferably from 0.5 to 1. The inks may be contained a thermoplastic resin fine particles. When the smooth gradation of the image is reproduced by the mixing of the high- and low-density inks, it is preferable in such the inks that the relation of $P/B \geqq p/b$ is satisfied for keeping the glossiness and the friction resistivity in the wide density range. In the above, P is the pigment content of the high-density ink in weight percent and B is the thermoplastic resin fine particle content of the high-density ink in weight percent, and p is the pigment content of the low-density ink in weight percent and b is the thermoplastic resin fine particle content of the low-density ink in weight percent.

In the set of inks which are different in the colorant content from each other, the ratio of the surface tension of the high-density ink $\gamma_a$ to that of the low-density ink $\gamma_b$ is preferably $1.2 \leqq \gamma_a/\gamma_b \leqq 0.8$, more preferably $1.1 \leqq \gamma_a/\gamma_b \leqq 0.9$. For reproducing the smooth gradation and keeping the high glossiness and friction resistively in the wide image density range, the surface tension of the high-density ink and that of the low-density ink are preferably as the same as possible. Examples of the colorant contained in the green ink include C.I. Pigment Green 7 and C.I. Pigment Green 36.

The thermoplastic resin may be contained in the ink for obtaining an image with high glossiness, low roughness and excellent friction resistively. As the thermoplastic fine particle to be added to the ink, ones the same as those described as the thermoplastic resin or fine particle can be used. Particularly, ones which do not cause viscosity increasing or precipitation are preferably applied. The average diameter of the thermoplastic fine resin particles is preferably controlled to be with in the range of from 10 nm to 200 nm for attaining the suitable storage stability of the ink and the foregoing objects of the addition of the fine particles. It is further preferable to select the average diameter of the thermoplastic fine particles so that the average diameter is from 0.2 to 2 times of the average diameter of the pigment particles in the ink from the viewpoint of the stability of the ink. The thermoplastic fine particle to be added is preferably one capable of fusing or softening at a temperature with in the range of from 50° C. to 200° C.

The addition of the thermoplastic resin particles into the black ink is particularly preferred from the viewpoint of the resistively to finger mark and the maximum density of the image.

A printer at least having a recording medium storing means, a recording medium conveying means, an ink cartridge and an ink-jet printing head as those as a usual printer available in the market is applicable for forming the ink-jet image according to the invention without any limitation. A system of printer set is advantageous for commercial application of the ink-jet photograph, which is constituted by at least a means for storing a roll-shape recording medium, a means for conveying the recording medium, an ink-jet print head, a means for cutting the recording medium, and a means for application of pressure, additionally a heating means and a means for storing recorded print.

The recording head is may be any of a Piezo type, a thermal type and a continuous type. The Piezo type is preferable from the viewpoint of ink releasing stability when the resin is added to the ink, and the thermal type is preferable for realizing a high speed compact printer since the nozzle accumulation degree can be raised in the thermal type head. The type of the head may be selected according to the composition of the ink or the design specification of the printer.

The ink-jet recording medium, on which an image is recorded by the ink imagewise released by the ink-jet method, is heated by a heat roller or a belt having a heat source, and subjected to a pressing treatment. The heating temperature should be higher than the glass transition temperature Tg of the thermoplastic resin contained in the outermost layer of the recoding medium. The glass transition temperature Tg is an inherent value of the thermoplastic resin to be used. Therefore, the heating temperature is different according to the kind of the thermoplastic resin. The upper limit of the heating temperature is usually approximately 150° C. from the viewpoint of the load on the apparatus and the heat stability of the support of the recording medium.

Between the heating roller and the belt, the average roughness of the roller surface to be touched with the image surface is not more than 100 nm. The average roughness can be preferably measured by, for example, Restplus no touching three dimensional micro surface shape measuring system, manufactured by WYCO Co., Ltd., since the surface roughness calibrated with respect to the curvature of the roller can be measured by the use of such the measuring apparatus. The above-mentioned average roughness is particularly preferable condition for the image forming using the pigment as the colorant. The average roughness of the roller surface is preferably from 20 to 90 nm, more preferably from 40 to 70 nm. In the fixing method by heating and pressing usable in the invention, a pair of heating rollers, a pare of heat-pressing belt, and a heat-pressing device constituted by a belt to be touched with the image surface and a roller to be touched with the back surface of the image, are preferably used.

The roller to be used for the heat-pressing process according to the invention is preferably constituted by a metal roller or a silicone rubber roller. The metal roller may be made by a usual material such as iron and aluminum, and the roller may be covered with tetrafluoroethylen or polyterafluoroethylene-perfluoroalkyl vinyl ether copolymer for raising the heat resistively. The surface of the metal roller may also be finished as a mirror surface for raising the smoothness of the surface of the recording medium after the fixing. Furthermore, heat hardenable silicone is preferably coated on the roller or the belt for raising the glossiness of image after the fixing, a film is formed by hardening of the silicone by heating after the coating thereof. A nip was formed by deformation of the facing two rollers applying pressure. The width of the nip is usually from 1 to 20 mm, preferably from 1.5 to 7 mm. The pressure generated between the rollers is preferably from 0.5 to 10 MPa since the film formation is accelerated.

The pressure not less than 5 MPa is necessary for obtaining the satisfactory glossiness when the outermost layer contains the thermoplastic resin particles in the form of aqueous emulsion synthesized by in the presence of the polyvinyl alcohol having a degree of polymerization of from 1,500 to 4,500 as the protective colloid for the emulsion polymerization. However, the pressure should be not more than 20 MPa since a large wavy unevenness is occurred when an excessive pressure is applied. The pressure is preferably from 8 to 15 MPa.

The belt to be used in the heat-pressing process is preferably seamless one made by electroformed nickel, and the thickness is preferably from 10 to 100 $\mu$m. A material other than nickel such as aluminum and iron or polyethylene may be used as the material of the substrate. The thickness of the silicone resin layer is preferably from 1 to 50 $\mu$m, more preferably 10 to 30 $\mu$m in both of the roller and the belt substrate.

Drying before the heating is described below.

In the invention, it is preferable to dry the recorded image before the heat treatment for obtaining high glossiness. Particularly, the dying is necessary when the outermost layer contains the thermoplastic resin particles in the form of aqueous emulsion synthesized in the presence of the polyvinyl alcohol having a degree of polymerization of from 1,500 to 4,500 as the protective colloid for the emulsion polymerization, which is the secondary embodiment of the invention.

The foregoing drying can be performed by air supplied from a fan positioned between the printing portion and the heat fixing portion or heating by a halogen lump provided at the same position and by the combination of these means. The object of the drying process is to evaporate a suitable amount of the evaporizable component of the ink from the recording medium. For example, in an image formed by relatively large amount of the ink of from 20 ml/m$^2$, the drying so as to evaporate from 1 to 10 g/m$^2$ of the evaporizable component is necessary.

Figure 2:
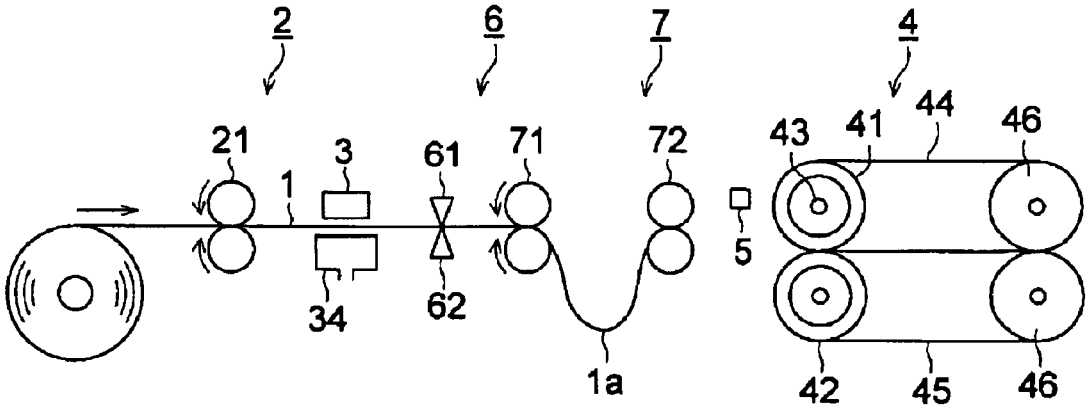
FIG. 2 shows a schematic constitution of an example of the ink-jet recording apparatus to be used in the invention having a heating roller with belt.

FIG. 1 shows an example of the ink-jet recording apparatus usable in the invention which has the fixing rollers. FIG. 2 shows another example of the ink-jet recording apparatus usable in the invention which has the belt type heat-fixing roller.

The symbols in the drawings are as follows:

| | |
|---|---|
| 1: | Recording medium |
| 1a: | Slackening portion |
| 2: | Means for conveying recording medium |
| 21: | Pair of conveying rollers |
| 3: | Recording head |
| 34: | Recording medium holding portion |
| 4: | Heat-pressing means |
| 41: | Heating roller |
| 42: | Pressing roller |
| 43: | Heater |
| 44: | Heating belt |
| 45: | Lower belt |
| 46: | Subordinately rotating roller |
| 5: | Temperature sensor |
| 6: | Means for cutting recording medium |
| 61 and 62: | Cutter |
| 7: | Means for forming slackening |
| 71: | First roller pair |
| 72: | Second roller pair |

EXAMPLES

The invention is concretely described referring examples.

Example 1

Preparation of Ink-Jet Recording Medium

An ink-jet recording medium was prepared according to the following procedures.

Preparation of Silica Dispersion 1

In 620 liter of purified water having a pH value of 2.5 adjusted by nitric acid, 125 kg of silica having average diameter of primary particle of 0.012 μm prepared by gas phase method QS-20, produced by Tokuyama Corp., was dispersed by suction by Jet Stream Inductor Mixer TDS, manufactured by Mitamura Riken Kogyo Co., Ltd., at a room temperature, and then made up to 694 l by purified water to prepare Silica Dispersion 1.

Preparation of Silica Dispersion 2

To 18 l of an aqueous solution containing 1.14 kg of the following cationic polymer P-1, 2.2 l of ethanol, 1.5 l of n-propanol and having a pH value of 2.3 and 9.4 l of the above-prepared Silica Dispersion 1 were added while stirring and then 7.0 l of an aqueous solution 260 g of boric acid, 230 g of borax and further 1 g of defoaming agent SN381.produced by San Nopco Limited were added. The mixture was dispersed by a high-pressure homogenizer manufactured by Sanwa Kogyo Co., Ltd., and made up to the total amount of 97 l by purified water to prepare Silica Dispersion 2.

P-1

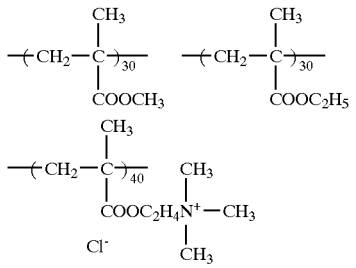

Mn = 13,000

Preparation of Lower Layer Coating Liquid

Into 600 ml of the above-prepared Silica Dispersion 2, the following additives were mixed while stirring at 40° C. in the order to prepare a lower layer coating liquid.

10% aqueous solution of polyvinyl alcohol PVA203 (KURARAY CO., LTD.) 6 ml

7% aqueous solution of polyvinyl alcohol PVA235 (KURARAY CO., LTD.) 185 ml

The mixture was made up to 1,000 ml by purified water.

Preparation of Upper Layer Coating Liquid

Upper layer coating liquids were prepared each using dispersions of methyl methacrylate-acrylic acid ester copolymers each having a glass transition temperature of 80° C. and an average particle diameter of 150 nm each prepared in the presence of the various kinds of polyvinyl alcohol each having different degree of polymerization described in Table 1, respectively, and the foregoing Silica Dispersion 2. In the liquids, the solid component ratio by weight of the thermoplastic fine particle to the silica was controlled so as to be 40:60.

Preparation of Recording Media 101 Through 107

On a paper support covered with polyethylene on both sides thereof, the foregoing lower layer coating liquid was coated as the first layer, in the order from the support, so that the wet layer thickness was 200 μm and the foregoing upper layer coating liquid was coated so that the weight of the solid component of the thermoplastic resin was 3.0 g/m$^2$, and dried. Samples 101 through 107 were thus prepared. The paper support was RC paper having a thickness of 220 μm and the polyethylene coated on the side of the ink absorption layer contained anatase type titanium dioxide in an amount of 13% by weight.

Preparation of Recording Media 108 Through 110

Recording Media 108 through 110 were prepared according to the conditions described in Table 1, in which the support was changed to cast coated paper having a thickness of 180 μm.

Preparation of Recording Media 111 Through 113

Recording Media 111 through 113 were prepared according to the conditions described in Table 1, in which the support was changed to water absorbable support or raw paper for coated paper having a thickness of 165 μm.

Preparation of Recording Media 114 and 115

Recording Media 114 and 115 were prepared according to the conditions described in Table 1, in which the support was changed to synthesized paper.

Preparation of Ink

Preparation of Yellow Pigment Dispersion 1

| | |
|---|---|
| C.I. Pigment Yellow 74 | 20% by weight |
| Styrene-acrylic acid copolymer (Molecular weight: 10,000, Acid value: 120) | 12% by weight |
| Diethylene glycol | 15% by weight |
| Deionized water | 53% by weight |

The above components were mixed and dispersed by a lateral beads mill System Zeta Mini, manufactured by Ashizawa Co., Ltd., filled in a volume ratio of 60% by 0.3 mm zirconia beads to prepare Yellow Pigment Dispersion 1. The average particle diameter of the yellow pigment in thus obtained dispersion was 112 nm.

Preparation of Magenta Pigment Dispersion 1

| | |
|---|---|
| C.I. Pigment Red 122 | 25% by weight |
| Johncryl 61 (Acryl-styrene resin produced by Johnson Co., Ltd.) | 12% by solid weight |
| Diethylene glycol | 15% by weight |
| Deionized water | 42% by weight |

The above components were mixed and dispersed by a lateral beads mill System Zeta Mini, manufactured by Ashizawa Co., Ltd., filled in a volume ratio of 60% by 0.3 mm zirconia beads to prepare Magenta Pigment Dispersion 1. The average particle diameter of the magenta pigment in thus obtained dispersion was 105 nm.

Preparation of Cyan Pigment Dispersion 1

| | |
|---|---|
| C.I. Pigment Blue 15:3 | 25% by weight |
| Johncryl 61 (Acryl-styrene resin produced by Johnson Co., Ltd.) | 15% by solid weight |
| Glycerol | 10% by weight |
| Deionized water | 50% by weight |

The above components were mixed and dispersed by a lateral beads mill System Zeta Mini, manufactured by Ashizawa Co., Ltd., filled in a volume ratio of 60% by 0.3 mm zirconia beads to prepare Magenta Pigment Dispersion 1. The average particle diameter of the cyan pigment in thus obtained dispersion was 87 nm.

Preparation of Black Pigment Dispersion 1

| | |
|---|---|
| Carbon black | 20% by weight |
| Styrene-acrylic acid copolymer (Molecular weight: 7,000, Acid value: 150) | 10% by weight |
| Glycerol | 10% by weight |
| Deionized water | 60% by weight |

The above components were mixed and dispersed by a lateral beads mill System Zeta Mini, manufactured by Ashizawa Co., Ltd., filled in a volume ratio of 60% by 0.3 mm zirconia beads to prepare Black Pigment Dispersion 1. The average particle diameter of the black pigment in thus obtained dispersion was 75 nm.

Preparation of High-Density Yellow Ink 1

| | |
|---|---|
| Yellow Pigment Dispersion 1 | 15% by weight |
| Ethylene glycol | 20% by weight |
| Diethylene glycol | 10% by weight |
| Surfactant (Surfinol 465, Nissin Chemical Industry Co., Ltd..) | 0.1% by weight |
| Deionized water | 54.9% by weight |

The above components were mixed and stirred and filtered by a 1 μm filter to prepare High Density Yellow Ink 1. The average particle diameter of the pigment in this ink was 120 nm and the surface tension of the ink was 36 mN/m.

Preparation of Low-Density Yellow Ink 1

| | |
|---|---|
| Yellow Pigment Dispersion 1 | 3% by weight |
| Ethylene glycol | 25% by weight |
| Diethylene glycol | 10% by weight |
| Surfactant (Surfinol 465, Nissin Chemical Industry Co., Ltd..) | 0.1% by weight |
| Deionized water | 61.9% by weight |

The above components were mixed, stirred and filtered by a 1 μm to prepare Low Density Yellow Ink 1. The average particle diameter of the pigment in this ink was 118 nm and the surface tension of the ink was 37 mN/m.

Preparation of High-Density Magenta Ink 1

| | |
|---|---|
| Magenta Pigment Dispersion 1 | 15% by weight |
| Ethylene glycol | 20% by weight |
| Diethylene glycol | 10% by weight |
| Surfactant (Surfinol 465, Nissin Chemical Industry Co., Ltd..) | 0.1% by weight |
| Deionized water | 54.9% by weight |

The above components were mixed, stirred and filtered by the 1 μm filter to prepare High Density Magenta Ink 1. The average particle diameter of the pigment in this ink was 113 nm and the surface tension of the ink was 35 mN/m.

Preparation of Low-Density Magenta Ink 1

| | |
|---|---|
| Magenta Pigment Dispersion 1 | 3% by weight |
| Ethylene glycol | 25% by weight |
| Diethylene glycol | 10% by weight |
| Surfactant (Surfinol 465, Nissin Chemical Industry Co., Ltd..) | 0.1% by weight |
| Deionized water | 61.9% by weight |

The above components were mixed and stirred and filtered by the 1 μm filter to prepare Low-Density Magenta Ink 1. The average particle diameter of the pigment in this ink was 110 nm and the surface tension of the ink was 37 mN/m.

Preparation of High-Density Cyan Ink 1

| | |
|---|---|
| Cyan Pigment Dispersion 1 | 10% by weight |
| Ethylene glycol | 20% by weight |
| Diethylene glycol | 10% by weight |
| Surfactant (Surfinol 465, Nissin Chemical Industry Co., Ltd..) | 0.1% by weight |
| Deionized water | 59.9% by weight |

The above components were mixed, stirred and filtered by the 1 μm filter to prepare High Density Cyan Ink 1. The average particle diameter of the pigment in this ink was 95 nm and the surface tension of the ink was 36 mN/m.

Preparation of Low-Density Cyan Ink 1

| | |
|---|---|
| Cyan Pigment Dispersion 1 | 2% by weight |
| Ethylene glycol | 25% by weight |
| Diethylene glycol | 10% by weight |
| Surfactant (Surfinol 465, Nissin Chemical Industry Co., Ltd..) | 0.1% by weight |
| Deionized water | 62.8% by weight |

The above components were mixed, stirred and filtered by the 1 μm filter to prepare Low-Density Magenta Ink 1. The average particle diameter of the pigment in this ink was 92 nm and the surface tension of the ink was 33 mN/m.

Preparation of High-Density Black Ink 1

| | |
|---|---|
| Black Pigment Dispersion 1 | 10% by weight |
| Ethylene glycol | 20% by weight |
| Diethylene glycol | 10% by weight |
| Surfactant (Surfinol 465, Nissin Chemical Industry Co., Ltd..) | 0.1% by weight |
| Deionized water | 59.9% by weight |

The above components were mixed, stirred and filtered by the 1 μm filter to prepare High Density Cyan Ink 1. The average particle diameter of the pigment in this ink was 85 nm and the surface tension of the ink was 35 mN/m.

Preparation of Low-Density lack Ink 1

| | |
|---|---|
| Magenta Pigment Dispersion 1 | 2% by weight |
| Ethylene glycol | 25% by weight |
| Diethylene glycol | 10% by weight |
| Surfactant (Surfinol 465, Nissin | 0.1% by weight |
| Deionized water | 62.9% by weight |

The above components were mixed, stirred and filtered by the 1 μm filter to prepare Low-Density Black Ink 1. The average particle diameter of the pigment in this ink was 89 nm and the surface tension of the ink was 36 mN/m.

Printing Out of Ink-Jet Image

An image was printed out by the printer shown in FIG. 2 which had a print head adaptable for eight colors. The printed image included wedge images of yellow (Y), magenta (M), cyan (C) and black (Bk), respectively, and a lattice shaped test chart in which 1 cm width belts respectively colored by Y, M, C, blue (B), green (G), red (R) and Bk were drawn in the lengthwise direction and the across direction, and a portrait.

The heat treatment after the image formation was performed by a belt type fixing means at a surface temperature of 120° C. for fusing and filming the thermoplastic resin in the outermost layer.

FIG. 2 shows a schematic drawing of the constitution of the ink-jet recording apparatus having a belt type fixing means, which was used in this example.

The inks of Y, M, C and Bk were set on the eight color printing head and the recording medium in a role shape having a width of 12.7 mm was set in apparatus. The recording medium was cut every 8.9 cm by a cutter built in the apparatus. L size prints were continuously made out.

The above-prepared recording media 101 through 117 were evaluated with respect to the crack occurrence, the glossiness, the color bleed or the ink absorption speed according to the following norms.

Evaluation of the Color Bleeds

The color bleeds relating to the ink absorption was evaluated. The degree of the color spreading at each of the boundary of the band shaped test charts of Y, M, C, B, G, R and Bk was visually evaluated.

A: Almost no color spreading was observed at the boundaries of all the colors.

B: The color spreading was slightly observed at the boundaries one or two colors; no problem was caused in the practical use.

C: The color spreading was observed with respect to several colors.

D: The intensive color spreading was observed with respect to several colors.

TABLE 1

| Sample No. | Support | Ploymerization degree of PVA | Thermoplastic resin adding position | Heat treatment | Cracks | Glossiness | Color bleed | Remarks |
|---|---|---|---|---|---|---|---|---|
| 101 | RC | 200 | *1 | With | C | B | A | Inv. |
| 102 | RC | 300 | *1 | With | B | A | A | Inv. |
| 103 | RC | 500 | *1 | With | B | A | A | Inv. |
| 104 | RC | 500 | *1 | Without | B | D | A | Comp. |
| 105 | RC | 1300 | *1 | With | A | A | A | Inv. |
| 106 | RC | 1300 | *2 | With | B | B | B | Inv. |
| 107 | RC | 1300 | *1 | Without | A | D | A | Comp. |
| 108 | Cast coate paper | 300 | *1 | With | D | D | A | Comp. |
| 109 | Cast coate paper | 300 | *1 | Without | D | D | A | Comp. |
| 110 | Cast coate paper | 1300 | *1 | With | B | D | A | Comp. |
| 111 | Water absorable paper | 500 | *1 | With | C | D | A | Comp. |
| 112 | Water absorable paper | 1300 | *1 | With | B | D | A | Comp. |
| 113 | Water absorable paper | 1300 | *1 | Without | B | D | A | Comp. |
| 114 | Synthesized paper | 500 | *1 | With | B | C | B | Comp. |
| 115 | Synthesized paper | 500 | *1 | Without | B | C | B | Comp. |

Comp.; Comparative Inv.; Inventive
*1; In the outermost layer only
*2; Uniformly in all the layers Evaluation of the Crack Occurrence Number of the crack occurred on 10 square centimeter the sample was counted.

A: No crack

B: 3 or less cracks (no problem in the practical use)

C: 4 to 10 cracks (problems were caused in the practical use.)

D: 11 or more cracks

Evaluation of the Glossiness

A: Very high glossiness higher than that of a silver salt photograph

B: Glossiness equal to that of a silver salt photograph

C: Glossiness less than that of a silver salt photograph

D: Considerably low glossiness

Table 1 clearly shows that the comparative samples without heat treatment were considerably inferior in the glossiness to the inventive samples among the samples having the RC paper as the support. The comparative samples using the polyvinyl alcohol having the degree of polymerization without the range of the invention were inferior to the inventive samples in the glossiness and the crack occurrence. Furthermore, it is clear that Samples 108 through 115 using the supports without the invention are also inferior in overall to the samples according to the invention.

Example 2

Recording Media 201 through 205 were prepared in the same manner as in Recording Medium 103 except that the coated amount of the thermoplastic resin was varied as shown in Table 2. The samples were evaluated in the same manner as in Example 1.

TABLE 2

| Sample No. | Support | Polymerization degree of PVA | Coated amount of thermoplastic resin (g/m$^2$) | Cracks | Glossiness | Color bleed | Remarks |
|---|---|---|---|---|---|---|---|
| 201 | RC | 500 | 0.5 | A | B | A | Inventive |
| 202 | RC | 500 | 1.2 | A | A | A | Inventive |
| 203 | RC | 500 | 9.5 | A | A | A | Inventive |
| 204 | RC | 500 | 18 | B | A | B | Inventive |
| 205 | RC | 500 | 23 | B | A | B | Inventive |

The results of Samples 201–205 are without problems in the practical use, but it is clear that Samples 202 and 203 having an amount of thermoplastic resin particles from 1 to 10 g/m$^2$ are superior in overall to the other samples.

Example 3

Samples 301 through 305 were prepared in the same manner as in Recording Medium 103 except that the degree of polymerization of PVA was 1,000 and the degree of saponification of PVA was as described in Table 3.

TABLE 3

| Sample No. | Support | Degree of polymerization of PVA | Saponification degree of PVA | Cracks | Glossiness | Color bleed | Remarks |
|---|---|---|---|---|---|---|---|
| 301 | RC | 1000 | 99 | B | B | A | Inv. |
| 302 | RC | 1000 | 88 | A | A | B | Inv. |
| 303 | RC | 1000 | 80 | A | A | B | Inv. |
| 304 | RC | 1000 | 72 | A | A | B | Inv. |
| 305 | RC | 1000 | 33 | A | A | B | Inv. |

Inv.; Inventive

The results of Samples 301–305 are without problems in the practical use, but it is clear that Samples 302 through 305 having a degree of saponification of not more than 90 mol % are superior in overall to the other samples.

Example 4

Recording Media 401 through 410 were prepared in the same manner as in Recording Media 103 except that the degree of polymerization of polyvinyl alcohol using for synthesizing of the thermoplastic resin particles to be used in the outermost layer was changed as shown in Table 4. The drying was carried out under the following condition.

The paper support covered by polyethylene on both sided thereof was used as the support. The support had a thickness of 220 μm and the polyethylene coated on the side of the ink absorption layer contained anatase type titanium dioxide in an amount of 13% by weight. The following Lower Layer Coating Liquid 1 as the first layer from the support surface, and the following Upper Layer Coating Liquid 1 as the second layer, were simultaneously coated by a slide hopper and dried. The coating liquid was heated by 40° C. for coating. The coated support was cooled for 20 seconds in a cooling zone held at 0° C., and dried for 60 seconds by air with a temperature of 25° C. and a relative humidity of 15%, and further dried for 60 seconds by air with a temperature of 55° C. and a relative humidity of 25%, and then conditioned for 2 minutes in an atmosphere of from 20° C. to 25° C. and relative humidity of from 40 to 60%.

The image formation was carried out in the same manner as in Sample 103 except that the printer shown in FIG. 2 had a drying means composed of a fan and a heater before the cutter 61 and the pressure for heating treatment. Pressure of 3 MPa is applied naturally without special pressure. For samples 403, 408 and 409, pressure of 10 MPa as a whole was applied.

Preparation Method of Heating Belt 44

Electroformed nickel having a thickness of 40 μm was used as the material of the belt. A mold-releasing layer was provided on the belt by the following method. Providing of the mold-releasing layer 1. Preparation of Coating Liquid for Mold-Releasing Layer Mold-Releasing Layer Coating Solution KS803E

| | |
|---|---|
| Mold-releasing layer coating solution KS803E (Shin-Etsu Chemical Co., Ltd.) | 500 g |
| Catalyst for hardening CAT-PL-50T (Shin-Etsu Chemical Co., Ltd..) | 5 ml |
| Toluene | 1500 ml |

The above materials were mixed and stirred to prepare the mold-releasing layer coating liquid.

2. Coating of Mold-Releasing Layer

Two liters of thus prepared mold-releasing layer coating liquid was put in a cylindrical beaker having an internal diameter of 15 cm and a height of 50 cm. The metal roller was set on a dipping coating machine available in the market and downed into the beaker so that the metal roller was immersed into the coating liquid, and then the metal roller was pulled up at a speed of 15 mm per second to coating the liquid. After standing for 5 minutes, the coated roller was heated for 1 hour in an oven kept at 100° C. Thus the mold releasing layer was provided.

Evaluation of Crack Occurrence During Prolonged Storage

Each of the images formed each samples were repeatedly exposed to the following conditions: 40° C. and 80% RH for 1 day and then 25° C. and 50% RH for 3 days. Number of day for occurring cracks on the surfaces of solid images of yellow, magenta, cyan and black was measured. The crack occurrence during the prolonged storage was defined by the average of the day number with respect to the respective colors.

A: Crack was not occurred by 200 days in total.

B: Cracks were occurred within the range of from 16 to less than 100 days.

C: Cracks were occurred within 15 days in total.

TABLE 4

| Sample No. | Polymerization degree of PVA | Drying before heat-pressing | Pressure at heat treatment (MPa) | Cracks | Glossiness | Color bleed | Crack occurrence during prolonged storage | Remarks |
|---|---|---|---|---|---|---|---|---|
| 401 | 500 | Without | 3 | C | A | A | C | Inv. |
| 402 | 1700 | With | 3 | B | A | A | B | Inv. |
| 403 | 1700 | With | 10 | B | A | A | B | Inv. |
| 404 | 1700 | Without | 3 | B | B | A | B | Inv. |
| 405 | 2000 | With | 3 | B | B | A | B | Inv. |
| 406 | 2400 | With | 3 | B | B | A | B | Inv. |
| 407 | 2800 | With | 3 | A | B | B | A | Inv. |
| 408 | 3500 | With | 10 | A | B | B | A | Inv. |
| 409 | 4500 | With | 10 | A | B | B | A | Inv. |
| 410 | 5000 | Without | 3 | B | D | C | B | Comp. |

Comp.; Comparative
Inv.; Inventive

An ink-jet image improved in the crack occurrence, the glossiness and the color bleed or ink absorption speed can be provided by the invention.

What is claimed is:

1. An ink-jet image recording method comprising;

forming an image by jetting ink on an ink-jet recording medium having at least one ink absorption layer on resin coated paper, the outermost layer of the ink jet recording medium comprising an aqueous emulsion of thermoplastic resin particles synthesized in the presence of polyvinyl alcohol as a protective colloid for emulsion polymerization, and then treating the recording medium by heat.

2. The ink-jet image recording method of claim 1 wherein the polyvinyl alcohol has a degree of polymerization from 300 to 1,500.

3. The ink-jet image recording method of claim 1 wherein the polyvinyl alcohol has a degree of saponification of not more than 90 mol %.

4. The ink-jet image recording method of claim 1 wherein glass transition temperature of the thermoplastic resin particles is from 40 to 100° C.

5. The ink-jet image recording method of claim 1 wherein an average particle diameter of the thermoplastic resin particles is not more than 300 nm.

6. The ink-jet image recording method of claim 1 wherein amount of the thermoplastic resin particles is from 1 to 10 $g/m^2$.

7. The ink-jet image recording method of claim 1 wherein the outermost layer further contains inorganic fine particle.

8. The ink-jet image recording method of claim 1 wherein the ink is a pigment ink.

9. The ink-jet image recording method of claim 1 wherein the polyvinyl alcohol having a degree of polymerization of from 1,500 to 4,500.

10. The ink-jet image recording method of claim 9 wherein the method comprises drying between the forming an image and the treating by heat.

11. The ink-jet image recording method of claim 9 wherein treating the recording medium by heat is accompanied simultaneously by pressure with a pressure of from 5 to 20 MPa.

12. The ink-jet image recording method of claim 9 wherein amount of the thermoplastic resin particles is from 1 to 10 $g/m^2$.

13. The ink-jet image recording method of claim 9 wherein the outermost layer further contains inorganic fine particle.

14. The ink-jet image recording method of claim 9 wherein the ink is a pigment ink.

15. The ink-jet image recording method of claim 1 wherein the recording medium has one ink absorption layer.

16. The ink-jet image recording method of claim 1 wherein the recording medium has two ink absorption layers.

* * * * *